US005876661A

United States Patent [19]

Bachy

[11] Patent Number: 5,876,661

[45] Date of Patent: Mar. 2, 1999

[54] HEATER FOR TANKS CONTAINING A BATH OF MOLTEN METAL

[75] Inventor: Damien Bachy, Waterloo, Belgium

[73] Assignee: Le Four Industriel Belge, Brussels, Belgium

[21] Appl. No.: 894,473

[22] PCT Filed: Mar. 19, 1996

[86] PCT No.: PCT/BE96/00030

§ 371 Date: Nov. 13, 1997

§ 102(e) Date: Nov. 13, 1997

[87] PCT Pub. No.: WO96/29442

PCT Pub. Date: Sep. 26, 1996

[30] Foreign Application Priority Data

Mar. 21, 1995 [BE] Belgium ..... 09500247

[51] Int. Cl.[6] ..... C23C 2/00

[52] U.S. Cl. ..... 266/44; 266/242

[58] Field of Search ..... 266/44, 200, 242

[56] References Cited

U.S. PATENT DOCUMENTS

| | | | |
|---|---|---|---|
| 3,635,457 | 1/1972 | King | 266/221 |
| 3,724,447 | 4/1973 | Parkhill et al. | 266/242 |
| 4,358,095 | 11/1982 | Debrey | 266/242 |
| 4,705,260 | 11/1987 | Geer et al. | 266/242 |

FOREIGN PATENT DOCUMENTS

| | | |
|---|---|---|
| 549431 | 1/1986 | Australia . |
| 72625 | 4/1960 | France . |
| 1268223 | 6/1961 | France . |
| 1133209 | 7/1962 | Germany . |
| 348024 | 9/1960 | Switzerland . |

*Primary Examiner*—Scott Kastler

*Attorney, Agent, or Firm*—Birch, Stewart, Kolasch, & Birch, LLP

[57] ABSTRACT

The invention relates to a method of heating tanks, such as galvanizing tanks, containing a bath of molten metal. Use is made of at least one element made of a refractory material which is thermally conducting and substantially gas-tight, particularly in relation to oxygen. The element is put into direct and permanent contact with the upper surface of the bath. A source of heat is positioned above or inside this element, making it possible to heat the latter and, by conduction, the bath itself

25 Claims, 1 Drawing Sheet

HEATER FOR TANKS CONTAINING A BATH OF MOLTEN METAL

BACKGROUND OF THE INVENTION

1. Field of the Invention

The present invention relates to a structure and a method for heating tanks containing a bath of molten metal, in particular galvanising tanks for steel wires in which the wires are moved in the form of a sheet in a substantially continuous manner in the direction of their length through a bath of molten zinc.

2. Description of the Related Art

These galvanising tanks may have a metallic crucible or a ceramic crucible.

Different methods of heating these tanks are currently in use.

If tanks with crucibles made of steel are used, it is essential that the temperature of the latter is limited to 450° C., given that above this temperature the iron in the crucible is easily taken into solution, with the result that the corrosion of the crucible by the molten zinc contained in it is accelerated.

Because of this, the method of heating such tanks should be designed so that the temperature of the crucible walls of the said tanks at no time exceeds the critical temperature of 450° C.

In this connection, there exist different heating methods, namely heating by high speed circulation of hot fumes, heating of the side walls by radiation making use of burners described as "flat flame burners", heating by electrical resistors placed along the walls and above the tank, and lastly induction heating.

For tanks with ceramic crucibles, these being formed by components made of a refractory material, even of cast concrete, there is consequently no limitation on the temperature, unlike in the case of tanks with steel crucibles.

Such tanks are generally heated by radiation of a cover placed above the surface of the bath or by immersion of silicon carbide heat exchange fingers.

However, these two types of heating have the disadvantage that, for example in the case of galvanising steel wires, the sheet of wires is accessible only with difficulty and, because of this, there is a restriction to fairly compact sheets of wires.

In addition, the thermal efficiency of installations equipped with these types of heating is generally very poor.

In the case of heating by radiation of a cover placed above the surface of the metallic bath, a major part of the metallic surface is used for heat transfer, so that, in the case of galvanising wires, a large part of the bath cannot be used for the passage of the wires to be galvanised. As a result of this, therefore, the productivity of such installations is somewhat lowered.

Moreover, the high temperature prevailing under the cover accelerates the oxidation of the metallic surface by the steam accumulating above this surface.

Another disadvantage is that this heating method does not allow a uniform distribution of temperature over the transverse cross-section of the bath.

As regards heating using "immersed fingers", the major disadvantages are that the tank is accessible only from one side and also the fact that, as in the aforesaid method of heating by radiation, the temperature is again not uniform over the transverse cross-section of the bath.

Furthermore, the level of the metallic bath must be lowered when a finger is being changed, because the hydrostatic pressure of the molten metal has to be overcome.

Finally, the fingers are sensitive to corrosion at the air-metal interface and it is impossible to start up the heating with these fingers immersed.

Documents FR-A-1 268 223, AU-A-O 544 531 and DE-B-1 133 209 relate to installations with fingers, bells or heating plungers which penetrate to a relatively substantial depth in the baths of metal being heated and which consequently exhibit the disadvantages already mentioned above.

BRIEF SUMMARY OF THE INVENTION

One of the main aims of the present invention is to propose a heating method enabling the various disadvantages described above to be overcome and to achieve this while ensuring very efficient heat transfer to the molten metal.

For this purpose, according to the invention, use is made of at least one element made of a refractory material which is thermally conducting and substantially gas-tight, particularly in relation to oxygen, and which floats on the surface of the above-mentioned bath.

The invention also relates to an installation for heating tanks containing a bath of molten metal, such as galvanising tanks, and more particularly, an installation for the implementation of the aforesaid method.

This installation is characterised by the fact that the element made of refractory material is positioned so that it can float on the bath of molten metal.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
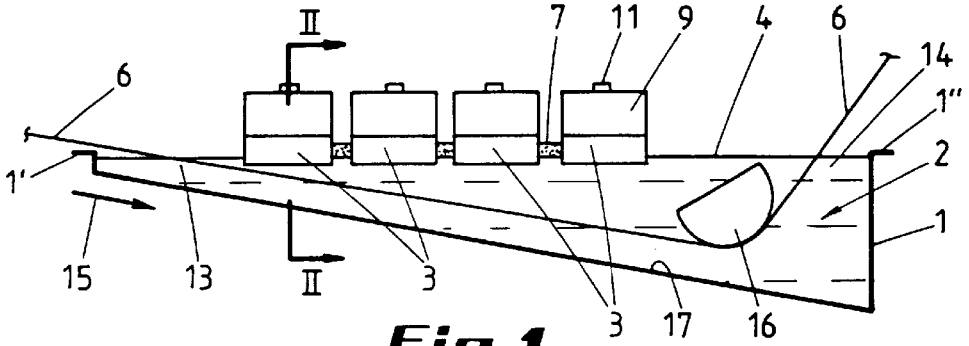
FIG. 1 is a diagrammatic side view a this first embodiment of the invention.

In the various figures, the same reference numbers designate identical elements.

The invention relates to a method of heating tanks 1 containing a bath 2 of molten metal according to which use is made of a succession of elements 3 made of a refractory material which is thermally conducting and substantially gas-tight, particularly as regards oxygen, put into direct and permanent contact with the upper surface 4 of the bath 2. A heat source 5 is positioned above this element 3 making it possible to heat the element 3, the heating of the bath 2 itself thus being mainly achieved by convection from this element 3.

With advantage, and particularly in order to ensure a relatively uniform heating of the bath 2, at least 60% of its upper surface 4 is covered by the elements 3 made of a refractory material.

In the embodiment shown in the figures, use is made of refractory elements 3 floating freely on the upper surface 4 of the bath 2 of molten metal.

Although the method according to the invention is in principle applicable to the heating of any type of molten metal bath, this method applies particularly to galvanising tanks containing a bath of molten zinc through which passes a sheet of steel wires 6 to be covered by a film of zinc.

For this reason, the description given below and the appended drawings to which reference is made in this description relate to the galvanising of steel wires.

In the particular embodiment represented in the drawings, use is made of refractory elements 3 formed by rectangular silicon carbide slabs placed freely alongside each other on the surface 4 of the bath 2, in the longitudinal direction of the tank 1, i.e. in the direction of movement of the sheet of wires 6.

These elements 3 are, in this specific embodiment, completely free with respect to each other, the remaining spaces forming junctions between two adjacent elements 3 being filled with granules of a refractory material 7, such as vermiculite granules. These junctions thus enable the relative movements of the elements 3 and any thermal expansion to be intercepted.

Although different types of a heat source 5 may be used to heat the refractory elements 3, preference is generally given, as illustrated by the drawings, to burners using air-gas fuel with or without premixing.

As is also shown in the drawings, the refractory elements 3 are with advantage placed on the bath 2 in such a way as to provide an access path 8 between the refractory elements 3 and the nearby edge of the tank 1 thus enabling the sheet of steel wires 6 to be easily positioned in the bath below the elements 3.

In addition to the technological arrangements described above, in connection with the heating method according to the invention, the embodiment of the installation for implementing this method comprises, above each of the elements 3, a cover 9 made of refractory material delimiting with the latter a space 10 in which the burners 5 emerging into this space 10 are mounted.

These burners 5 are directed towards the refractory element 3 thus heating the latter and also, by conduction, the bath 2 on which this element 3 is floating.

A single burner per element might possibly be provided and this is then fitted with several injectors.

Moreover, the burner or burners 5 mounted above a given refractory element 3 might possibly be completely independent of the burner or burners mounted above the other elements 3, so as to allow perfect control of the heating of the successive zones of the bath 2 through which the sheet of wires 6 to be galvanised is passed.

Moreover, one or more chimneys 11 are incorporated into each cover 9 in order to evacuate the combustion gases, and deflectors 12 are advantageously provided on each element 3 in the space 10, making it possible to control the circulation of the combustion gases in this space.

The tank 1 generally has a horizontal cross-section of rectangular shape. At each end of this tank there is a free zone, respectively 13 and 14, i.e. in which there is no heated refractory element 3, as shown in FIG. 1. The zone 13 forms the zone through which the sheet of wires 16 enters the bath 2, while the opposite zone 14 forms the exit zone. The arrow 15 indicates the direction in which the wires 6 move through the bath 2.

As can be observed, this sheet of wires 6 enters the zone 13 obliquely and moves in an inclined position with respect to the upper surface 4 of the bath 2. It then undergoes, in zone 14, an upward deviation around a guide ramp 16 extending transversely with respect to the tank 1 before leaving the bath 2 through this zone 14.

Advantageously, in order to restrict the concentration of zinc in the bath to a minimum, the bottom 17 of the tank 1 is also inclined and preferably extends parallel to the sheet of wires 6 below the refractory elements 3.

In the embodiment represented in the drawings, the elements 3 are positioned one after another along the lengthwise direction of the tank 1 while providing on both sides of each element an access passage 8 reserved for the insertion or positioning of the sheet of wires 6 in the bath 2, below the elements 3, as already mentioned above.

The width of this access passage 8 may, for example, be of the order of 10 cm.

The rectangular slabs forming, in this particular embodiment, the refractory elements 3 extend with their longer side transverse to the longitudinal direction of the tank. The length of the longer sides of these slabs thus corresponds to the internal width of the tank 1 reduced by twice the width of the access passage 8. Generally, this width is of the order of 1 to 2 meters. In the free zone 13 for the entry of the wires 6 into the bath 2, the distance separating the front edge 1' of the tank 1 from the first element 3 floating on the bath 2 is generally of the order of 1 meter. The central zone of the bath 2 in which the refractory elements 3 occur, generally extends over a distance of the order of several meters in the lengthwise direction of the wires 6 and the distance separating the last refractory element 3 from the rear edge 1 of the tank 1 is generally of the order of 1.5 to 2 meters.

Finally, the length of the shorter side of the refractory elements 3 is generally of the order of 75 cm, while the width of the spaces forming junctions separating two adjacent refractory elements is generally of the order of 10 to 20 cm.

The cover 9 may be placed freely on the corresponding element 3 or may be fixed to it. This cover a has on both sides, alongside the longitudinal edges of the tank 1, wings 18 accommodating guide rods 19, which stand vertically on the longitudinal edges of the tank so as to ensure that the movement of the element 3 coincides to the upper surface 4 of the bath 2 during a variation in the level of the latter.

Figure 2:
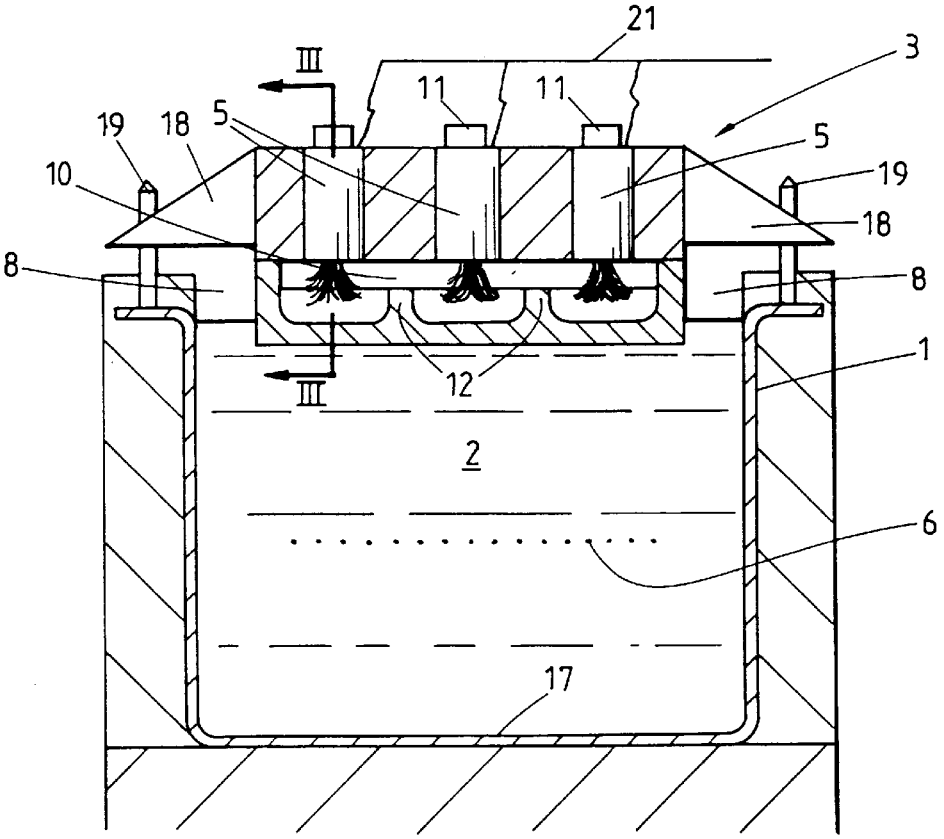
FIG. 2 is, on a larger scale, a diagrammatic cross-sectional view through the line II—II of FIG. 1.
Figure 3:
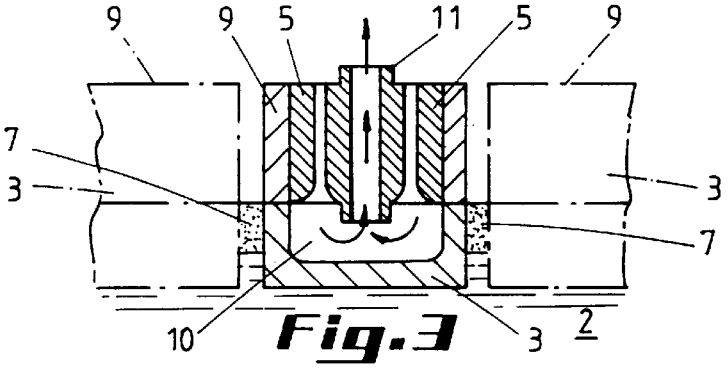
FIG. 3 is a transverse cross-sectional view through the line III—III of FIG. 2.

In a variant of the embodiment represented in FIGS. 1 to 3, the elements 3 could be locked into a given position with respect to the tank 1 in order to maintain intimate contact between this element 3 and the upper surface 4 of the bath 3. This could, for example, be achieved by providing means for fixing the wings 18 of the cover 9 into a given position on the guide rods 19.

In such a case, therefore, the elements 3 do not float freely on the bath 2 and may be slightly submerged in the latter. This can mainly be advantageous when the face of the elements 3 directed towards the bath has fins, not represented in the figures, with the aim of increasing heat exchanges between the elements 3 and the bath 2.

Finally, it is possible to provide for a common energy supply 21 for the burners 5 belonging to the same cover 9.

In another care, the end refractory elements 3 may be heated by the enthalpy of fumes coming from neighbouring elements 3. In this case, therefore, no separate burner is provided for the end elements.

In still another case, the elements 3 may be held together by a type of U-shaped bracket, not represented, which makes it possible to ensure their relative positions while avoiding the accumulation of matte in the spaces forming junctions between neighbouring elements.

It is important to note that the heating obtained by using the refractory element 3 is applicable to all molten metal baths, such as galvanising baths, tinning baths, baths of an alloy of Zn—Al, known under the commercial name "Galfan", etc.

The heating method, according to the invention, of such baths has the great advantage that the equipment is compact thanks to the fact that there is no longer any unused surface of the tank and this is achieved while still allowing easy access through the two passages 8 between the lateral edges of the tank 1 and the elements 3 for the threading operations in the case of galvanising wires.

The fact that the elements 3 are in permanent contact with the surface 4 of the bath 2 and that these elements are gas-tight makes it possible to avoid direct contact between the molten metal of the bath and the steam coming from combustion in the burners 5.

Another very important advantage in comparison with methods using immersed fingers is that it is possible to start up the installation when the metal is in the solid state in the tank.

It is to be fully understood that the invention is not limited to the different embodiments of the method and the installation according to the invention described above, but that different variants may be envisioned within the scope of the invention, as regards the nature of the refractory materials used, as regards the shape of the constituent parts, such as that of the refractory element 3 and of the cover 9 mounted on the latter, as regards the type of means used for heating, and as regards the materials forming the tank, which can therefore be either a tank with a metallic crucible, such as steel, or a tank with a ceramic crucible.

In certain cases, the heat source could for example consist of electrical resistors incorporated in the refractory elements 3.

I claim:

1. A method of heating a bath of molten metal in a galvanizing tank comprising:

providing at least one element made of a refractory material which is thermally conducting and substantially gas-tight, and a heat source being positioned above or inside the at least one element;

placing the at least one element into direct contact with an upper surface of the bath;

floating the at least one element on the upper surface of the bath; and heating the bath with the at least one element.

2. The method according to claim 1, wherein the at least one element includes a slab, and said placing step includes freely placing the slab on the upper surface of the bath.

3. The method according to claim 1, wherein said placing step includes covering at least 60% of the upper surface of the bath with the at least one element.

4. The method according to claim 1, wherein the at least one element includes plural elements, each element including a slab made of a refractory material, and said placing step includes freely placing the slabs on the upper surface of the bath.

5. The method according to claim 4, further comprising the step of fixing the plural elements to each other.

6. The method according to claim 1, wherein the at least one element includes plural juxtaposed elements with refractory material filling spaces between adjacent juxtaposed elements, the refractory material for accommodating thermal expansion of the plural juxtaposed elements, and wherein said placing step includes placing each of the juxtaposed elements into direct contact with the upper surface of the bath.

7. The method according to claim 1, wherein the heat source is a burner, and further comprising the step of heating the at least one element by burning an air-gas fuel in the burner.

8. The method according to claim 1, further comprising the steps of:

introducing a sheet of steel wires into the bath; and moving the sheet in the bath below the at least one element.

9. The method according to claim 1, wherein the tank includes side edges delineating the upper surface of the bath, and wherein the at least one element floats on the upper surface of the bath with a clearance between the side edges of the tank.

10. An apparatus for heating a bath of molten metal, said apparatus comprising:

at least one element made of a refractory material which is thermally conducting and substantially gas-tight;

a heat source positioned above or inside the at least one element; and a tank having a having the bath of molten metal therein, wherein said at least one element floats on an upper surface of the bath.

11. The apparatus according to claim 10, wherein said at least one element includes a slab floating freely on the upper surface of the bath.

12. The apparatus according to claim 10, wherein said at least one element covers at least 60% of the upper surface of the bath.

13. The apparatus according to claim 10, wherein said at least one element is locked in a fixed position against the upper surface of the bath.

14. The apparatus according to claim 10, wherein said at least one element includes a cover, a space being formed beneath said cover and within said at least one element for receiving a heat output of said heat source.

15. The apparatus according to claim 14, wherein said heat source is mounted within said cover.

16. The apparatus according to claim 15, wherein said heat source substantially converges its heat output onto said at least one element.

17. The apparatus according to claim 10, wherein said tank has a width and a length, said at least one element extending over substantially the entirety of said width of said tank.

18. The apparatus according to claim 17, wherein an access passage is provided between said at least one element and a widthwise edge of said tank.

19. The apparatus according to claim 10, wherein said heat source includes at least one burner.

20. The apparatus according to claim 19, wherein said burner is fitted with several injectors.

21. The apparatus according to claim 10, wherein said at least one element has the shape of a rectangular slab.

22. The apparatus according to claim 10, wherein said tank is a rectangular tank.

23. The apparatus according to claim 10, wherein said at least one element is formed of a silicon carbide based material.

24. The apparatus according to claim 10, wherein a face of said at least one element which contacts the bath includes fins for increasing heat exchanges between said at least one element and the bath.

25. The apparatus according to claim 10, wherein said at least one element includes a first guide, and said tank includes a second guide for cooperating with said first guide to allow said at least one element to move in unison with the upper surface of the bath.

* * * * *